United States Patent [19]

Rueda

[11] 4,362,247

[45] Dec. 7, 1982

[54] TACO STAND

[76] Inventor: Robert Rueda, 1034 SE. 122nd St., Portland, Oreg. 97233

[21] Appl. No.: 162,362

[22] Filed: Jun. 24, 1980

[51] Int. Cl.[3] ..... A47F 7/00

[52] U.S. Cl. ..... 211/13; 248/205 A

[58] Field of Search ..... 211/13, 14, 50, 45; 99/450.6, 441, 426, 418; 248/188.8, 188.9, 205 A, 346; D6/184; D7/72

[56] References Cited

U.S. PATENT DOCUMENTS

| | | | |
|---|---|---|---|
| 2,015,142 | 9/1935 | Hargreaves | D7/72 X |
| 3,311,338 | 3/1967 | Culley | 248/205 A |
| 4,270,660 | 6/1981 | Putt | 211/41 X |

*Primary Examiner*—William E. Lyddane
*Assistant Examiner*—Robert W. Gibson, Jr.
*Attorney, Agent, or Firm*—W. Britton Moore

[57] ABSTRACT

A portable stand for supporting a taco-like food product in position preparatory to consumption which includes a pair of spaced legs recessed at their upper ends to snugly accommodate the curved lower end of an open upper-ended generally V-shaped taco receiving holder including a pair of flat diverging walls so that a taco may be inserted therebetween and horizontally supported in the lower end thereof and the filling secured within the folded taco and prevented from being dislodged therefrom and whereby the taco may be lifted therefrom for consumption.

1 Claim, 3 Drawing Figures

TACO STAND

BRIEF SUMMARY OF THE INVENTION

This invention relates to a portable stand for supporting a taco-like food product on a plate or other flat surface which includes an open upper-ended generally V-shaped one piece holder having a pair of flat upwardly diverging walls joined at their lower ends to provide a concavity for snugly accommodating the lowermost folded side edge of and supporting a taco uprightly and horizontally with the side walls thereof engaging the diverging holder walls to retain the taco filler material therein and facilitate ready removal and reinsertion thereof during consumption.

CROSS REFERENCE TO PRIOR ART

Various trays and racks have been proposed for supporting slices of toast and frankfurter roll sandwiches, such as, those represented by U.S. Pat. Nos. to Snyder 2,592,203 and Silos 2,741,901. However, such devices are not peculiarly adapted for supporting and retaining a folded flat sided taco-like food product with a loose filling therebetween in an upright and horizontal position on a plate so that handling thereof during consumption is facilitated.

SUMMARY OF THE INVENTION

The principal object of the present invention is to provide a portable unitary stand for supporting a taco-like food product on a food plate in upright horizontal position so that the filling will be securely retained therein and the product may be removed and reinserted therein during consumption.

Another object is the provision of a generally V-shaped unitary holder having a pair of upwardly diverging walls joined at their lower ends to form a concavity for snugly accommodating the lowermost folded side edge of and supporting a taco uprightly and horizontally to facilitate ready handling during consumption.

A further object is to provide a relatively light stand with supporting feet which enables the stand to be arranged on a food plate and retain a taco therein in vertical and horizontal position.

These and other objects and advantages will be apparent as the specification is considered with the accompanying drawings, wherein FIG. 1 is a perspective view of a stand arranged on a food plate and having a taco supported therein in upright position preparatory to being removed and consumed;

DETAILED DESCRIPTION

Figure 1:
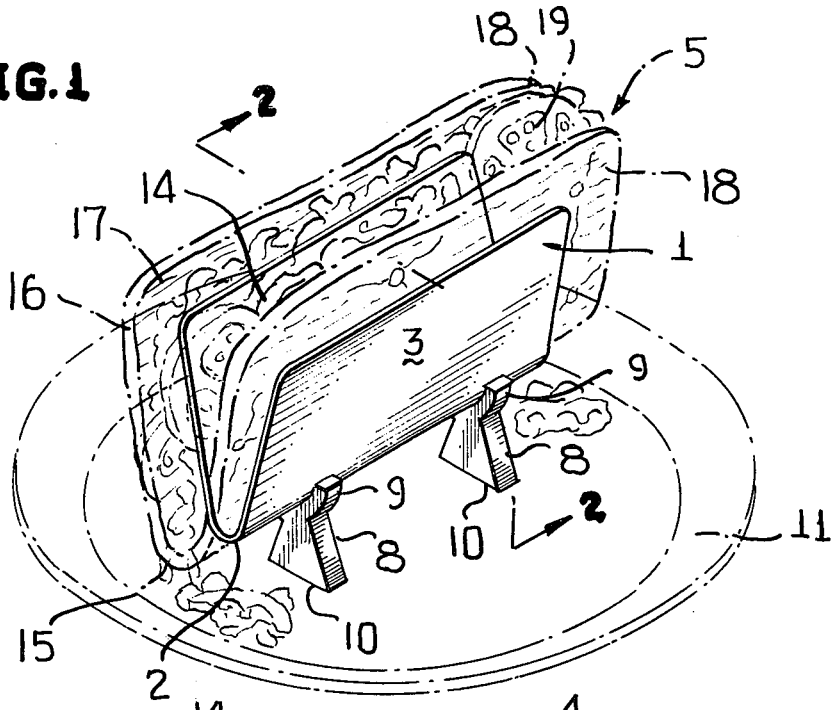

Referring more particularly to the drawings, wherein similar reference characters designate like parts throughout the several views, numeral 1 identifies a portable generally V-shaped unitary stand or holder formed from a suitable relatively thin material, such as metal or plastic, and bent along its median line 2 to provide upwardly diverging elongated flat walls 3 which provide a pocket 4 for mounting a taco 5.

Figure 2:
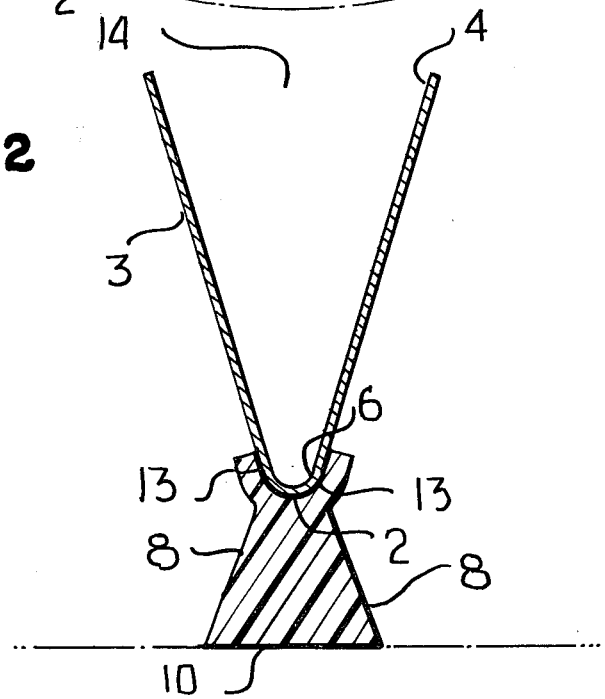
FIG. 2 is a section on the line 2—2 of FIG. 1.
Figure 3:
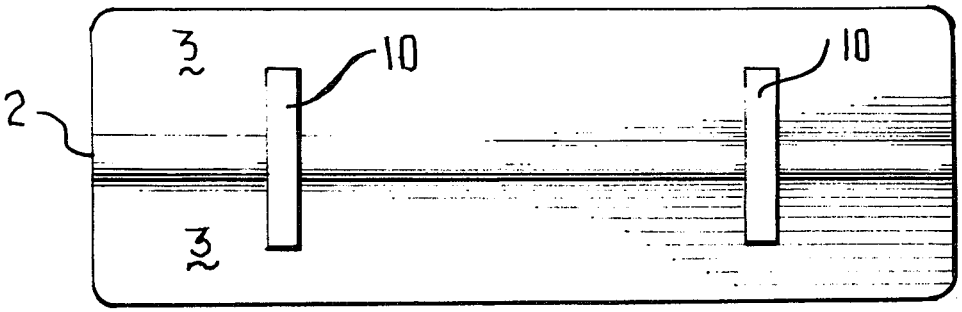
FIG. 3 is a bottom plan view.

Viewing FIGS. 1 and 2, the walls 3 are so bent adjacent median line 2 to form a concavity 6 for a purpose presently to be described, and which concavity interfits with similar concavities 7 in the flared upper ends 9 of a pair of spaced legs 8. The latter are flat and generally pyramid-shaped with flat undersides 10 which flatly engage the flat upper surface 12 of a conventional rimmed food plate 11, as best shown in FIG. 2, and serve to elevate the holder thereabove. The mating concavities 6–7 may be suitably and removably interconnected by fasteners, such as screws or the like, not shown, or a suitable tacky adhesive 13 may be interposed therebetween so that the holder will be retained in an upstanding position, with the widened mouth 14 thereof being uppermost.

With the holder 1 attached to the legs 8 and arranged on a food plate or other flat surface, a taco 5 is adaptable to be introduced into the diverging open mouth 14 thereof, as in FIG. 1. Such a taco usually consists of a relatively thin rectangular sheet of dough folded in half, as at 15, and baked to a crisp, somewhat rigid, generally V-shaped, sandwich-like, edible shell or crust 16, open along one side, as at 17, and between the walls 18 of which is inserted a suitable cooked stuffing or filler 19 of chopped vegetables, shredded chicken or meat, spicy sauces and the like.

When a taco 5 is vertically supported in the holder with its open mouth side uppermost and folded edge portion 15 downwardmost, the taco will fit between the diverging walls 3 and the folded edge portion thereof will abut the concavity 6 so that the taco will be securely supported therein in an upright position on the plate. Thus, the taco may be readily withdrawn therefrom and reinserted thereinto until fully consumed, during which the filling tends to be retained therein and prevented from being dislodged therefrom, such as would be the case if a holder or stand was not employed and the taco was horizontally supported on the plate.

While a preferred embodiment of taco stand has been shown and described, it is to be understood that various changes and improvements may be made without departing from the scope and spirit of the appended claims.

What I claim is:

1. A portable stand for vertically supporting a taco-like food product on a food plate in position for removal and consumption, wherein such product includes a generally flat rectangular folded baked crust with a stuffing therebeween, said stand comprising a generally V-shaped body having a pair of flat generally rectangular diverging walls concavedly joined at their lower edges, said body having an open upper end, spaced supporting leg means for vertically supporting said body, said leg means having generally flat and downwardly flared sides with flattened lower ends for flatly resting on said plate, the upper ends being concavedly recessed to snugly accommodate the concaved lower end of said body, and adhesive means interposed between said mating concavities for removably mounting said leg means thereon, whereby said taco-like product is downwardly positioned between said walls and engages with said concavity so as to be vertically arranged between and flatly engaged by said walls and relative to the plate.

* * * * *